United States Patent [19]

Underwood et al.

[11] 4,388,998

[45] Jun. 21, 1983

[54] LID AND CONTAINER WITH IMPROVED FASTENING AND SEALING MEANS

[75] Inventors: J. Larry Underwood, 104 Dixie Dr., Woodstock, Ga. 30188; Stephen M. Thompson, Stone Mountain; John S. Budde, Atlanta, both of Ga.

[73] Assignee: J. Larry Underwood, Atlanta, Ga.

[21] Appl. No.: 302,146

[22] Filed: Sep. 14, 1981

[51] Int. Cl.[3] ..... B65D 39/00

[52] U.S. Cl. ..... 220/307; 220/306; 220/354; 220/355; 220/356

[58] Field of Search ..... 220/307, 306, 354, 355, 220/356, 285, 286, DIG. 6, DIG. 19; 150/0.5

[56] References Cited

U.S. PATENT DOCUMENTS

| | | | |
|---|---|---|---|
| 1,157,041 | 10/1915 | Reynolds | 220/307 |
| 3,046,853 | 7/1962 | Legendre | 220/284 |
| 3,149,747 | 9/1964 | Burgess | 220/306 |
| 3,589,552 | 6/1971 | Fitzgerald | 220/307 |
| 3,902,628 | 9/1975 | Schurman | 220/306 |
| 4,201,311 | 5/1980 | Underwood | 220/307 |

*Primary Examiner*—George T. Hall

*Attorney, Agent, or Firm*—Barnes & Thornburg

[57] ABSTRACT

A container and lid of molded plastic material is disclosed having an integral fastening structure for connecting the lid onto the container, the fastener structure amounting to two series of longitudinally and radially reversely inclined interengaging elements, each element supported by an adjacent longitudinal surface. A lower portion of the fastener structure on the container is configured to communicate with the interior of the container below any sealing line between the container and lid. A sealing bead is provided integral with or above the fastener structure. Where the sealing bead is integral with the fastener structure, it takes the form of a dual sealing bead interrupted by the elements of the fastener structure. The lid further includes a central disk constituting a major portion of the lid and at least one intermediate ring-shaped step connecting the central disk to the lower edge of the longitudinal surface on the periphery of the lid. The intermediate ring-shaped step has at least one substantially thinner section than the remaining portions of the ring-shaped step for imparting flexibility between the central disk and the periphery of the lid.

22 Claims, 16 Drawing Figures

LID AND CONTAINER WITH IMPROVED FASTENING AND SEALING MEANS

The present invention is directed to containers molded of synthetic plastic material having integral means for fastening the lid to the container. The invention is specifically directed to improved means for ensuring a seal exists between the lid and container and for providing sufficient flexibility in the lid to permit the lid to withstand the shocks of handling and transporting the container when filled with a liquid.

A prior art container of this general class is disclosed in U.S. Pat. No. 4,201,311. The container disclosed in that patent includes a fastener structure to secure the lid onto the can which includes an endless peripheral series of complementary, interengaging fastener elements designed to create both an axial and radial pressure between the periphery of the lid and the mouth of the container to seal the container tightly. The two complementary series of elements, one projecting axially upward on the wall of the can, and one projecting downwardly on the rim of the lid, interengage when the cover is pressed down. The fastener elements disclosed in that patent included head portions which were wider than the base portions so that when the elements were interengaged they could not easily be separated by a force applied to the lid as a whole. However, when the force was concentrated at a point, as by a prying tool, a small number of elements at the point of prying can be disengaged and then the remaining elements separated to remove the lid from the container body.

The interengaging elements on the container and lid disclosed in U.S. Pat. No. 4,201,311 were provided with transversely inclined surfaces to produce both a radial and longitudinal force between the periphery of the container lid and the mouth of the container. The reversely inclined surfaces on the interengaging elements acted to exert both an axial and a radial pressure between the container and lid to ensure a continuous seal between the container and lid. While in most circumstances the container and lid disclosed in U.S. Pat. No. 4,201,311 operated in a fashion which was completely desirable, several conditions have been observed where the combination fails to perform in a completely satisfactory manner.

When such a container was filled with a liquid and dropped such that the container impacted on merely a point of the lip of the container, the force exerted on the container was much like that of a prying tool, and consequently, upon occasion, the lid would become partially separated from the container body, thus some loss of the contents was observed. It was therefore an object of the present invention to improve the lid design so as to increase the resistance of the lid to this type of separation.

An additional difficulty was observed when the rim of the container disclosed in U.S. Pat. No. 4,201,311 was coated with a liquid prior to attempting to place the lid onto the container. Upon occasion when this occurred, liquid would be retained in the spaces provided by the peripheral series of interengaging fastener elements. This liquid would then be subject to a compression force as the lid of the container was urged into its engaged position, thus requiring a greater than normal force to correctly seat the lid on the container. Since in conventional mechanized automatic filling lines, spillage of some liquid onto the lip of the container is not an unusual event, it is an object of the present invention to provide some means for providing an escape of any retained liquid in the spaces of the fastener structure during the lid-sealing process.

Yet another difficulty with the prior design was presented by the portion of the lid which depended below the interengaging fastener elements. In the prior designs, this depending portion was intended to mate with an inside surface of the container and at least partially seal the contents thereof when the lid was properly in position. This function required that the depending portion extend a substantial distance below the fastener elements, typically 0.35 inch. The space in the container above the lowest point of the depending portion was effective "lost head space" in that nothing but air could occupy this area if the normal filling sequence was followed. It is therefore another object of the present invention to minimize the lost head space by having the fastener elements situated at the lowest practical point on the lip of the lid.

These and other objects of the present invention have been satisfied by providing a lid for a container employing a fastener structure of the general kind disclosed in U.S. Pat. No. 4,201,311 wherein the lid includes a central disk constituting a major portion of the lid and at least one intermediate ring-shaped step connecting the central disk to a lower edge of the longitudinal surface at the periphery of the lid upon which the fastener structure is mounted. The at least one intermediate ring-shaped step includes at least one substantially radial section which can be downwardly and inwardly inclined, which is thinner than the remaining portions of the ring-shaped step for imparting flexibility between the central disk and the periphery of the lid. This flexibility acts as a shock-absorbing feature, thereby lowering the point forces which are applied to the fastener structure between the lid and container when the container is dropped on one point of the lip of the container.

The objects of the present invention are further satisfied by a container having a fastener structure of the general class disclosed in U.S. Pat. No. 4,201,311 wherein a sealing bead is included on the longitudinal surface supporting the fastener structure, the bead preferably being interrupted by the elements of the fastener structure. The presence of the bead tends to increase the pressure on the back-angled portions of the fastener structure, thus improving the sealing function performed by that portion of the structure. Below the sealing bead, the interdental spaces are maintained at a substantially constant width, and smoothly merge with the interior of the container below the sealing bead so as to permit drainage of any retained liquid. The lost head space is minimized by positioning the fastener structure adjacent (typically within 0.080 inch of) the lowest point on the lid.

The features and advantages of the present invention are obtained most easily by injection molding containers and lids having the various configurational features outlined herein. Materials suitable to carry out the injection molding are polyethylene, polypropylene, ethylene-vinyl acetate copolymers, propylene-modified polyethylene, acetals, acrylonitrile-butadiene-styrene, polystyrene blends, chlorinated polyether, fluro-based polymers, polyamides, vinyls, and polyvinylidene chloride. As is the usual practice, these resins can have fibrous reinforcement which gives greater impact, tensile, and flexural strength. The choice of materials and fillers used must satisfy the requirements that they be necessarily resilient or pliable for the action of the integral fastener on the lid and container lip. The preferred material for the container and lid is a high density polyethylene having a melt index of 4, density of 0.95, and a durometer of about 60 (Shore D).

The various features and advantages of the present invention will be appreciated by a consideration of the accompanying description of prior art devices, as well as the invention illustrated in the accompanying drawings, in which:

FIG. 1 is a sectional view of one form of a container and lid disclosed in U.S. Pat. No. 4,201,311;

FIG. 2 is a similar sectional view of a container and lid commercially sold in the United States employing a fastener structure as disclosed in U.S. Pat. No. 4,201,311;

(FIGS. 1–5 are not illustrative of the present invention, and rather are illustrative of the prior art);

Figure 1:
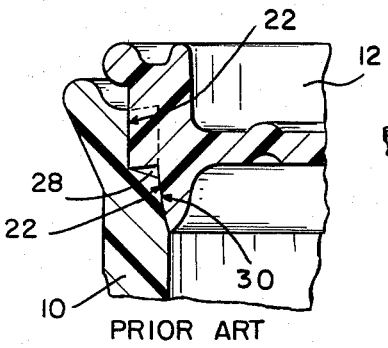
Figure 3:
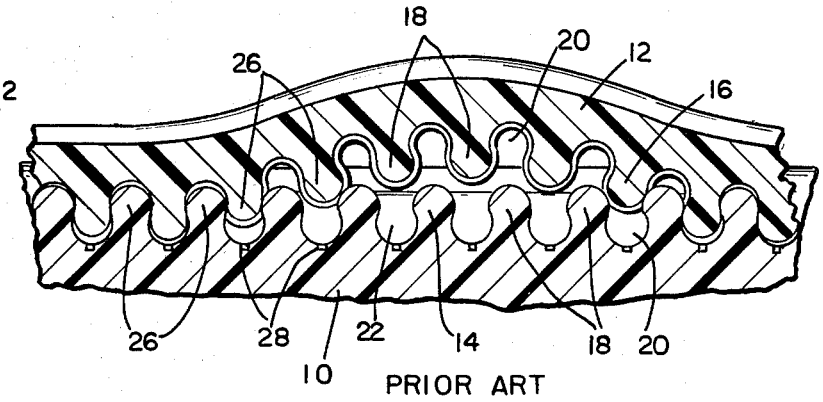
FIG. 3 is a sectional view through the fastener formation illustrated in FIG. 2, cut along line 3—3.

In prior art containers as illustrated in FIGS. 1–5, the container body 10 and lid 12 of molded plastic material each included an integral fastener structure 14 and 16, respectively. Each fastener structure 14 and 16 comprised a series of tooth-like elements 18 separated by interdental spaces 20. The two series of complementary interdigitating elements 18 were dimensioned so as to be able to be intermeshed in a fashion best illustrated in FIG. 3. Each member 18 of each series was supported by an adjacent longitudinal surface 22. Each member 18 of each series was wider at its extremity or free surface 24 than at its base fixed to the longitudinal supporting surface 22 as can best be seen in FIGS. 4 and 5, thus forming dovetail slots between each adjacent pair of members 18 of the same series. The inclined surfaces thus formed on the elements 18 exerted a radial force on the members of the series when the elements were interengaged and the container and lid fully in place.

Each member 18 of each series also had an enlarged head 26. When the elements 18 of the series were interengaged, the enlarged heads exerted a longitudinal force which resisted the separation of the two series 18, thereby maintaining the body 10 and lid 12 in an engaged configuration.

Narrow slots 28 were provided at the lower end of the interdental spaces 20 on the container body 10 so as to permit drainage of liquids from the interdental spaces. While the slots 28 perform the intended function when liquids of low viscosity were employed, viscous and adherent liquids such as paint were observed to not readily drain from the interdental spaces 20 on the container body 10. Thus, when lid 12 was positioned for engagement on body 10 and a downward force was applied to lid 12, liquid would be retained between the smoothly interengaging elements 18 and the seal formed between wall 22 on lid 12 and wall 30 on container body 10. The application of a greater than normal force was then required to correctly seat the lid on the container. Other difficulties were presented by the prior design, which difficulties have been previously discussed. The present invention is intended to alleviate these difficulties.

Figure 6:
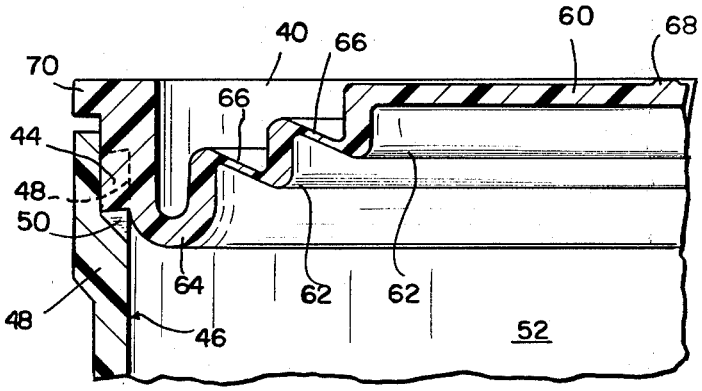
FIG. 6 is a fragmentary sectional view of one form of the present invention illustrating the shock-absorbing features of a lid constructed according to the present invention.

In FIG. 6, there is illustrated an improved lid and container according to the present invention. The lid 40 and container body 42 includes a peripheral fastener structure 44 similar to that discussed in connection with the prior art FIGS. 1–5 but with significant differences, as will become apparent from a discussion of the remaining figures in the present disclosure.

A first difference may be noted by considering the interior wall surface 46 of container body 42 and its relationship to the longitudinal surface 48 supporting the tooth-like elements of lid 40. It will be noted from FIG. 6 that when the lid 40 and container body 42 are fully engaged as illustrated in FIG. 6, the lower end of slot 50, which is similar to slot 28 in the prior art, communicates with the interior 52 of the container. While space 50 is shown to communicate directly with interior 52 as the fastener structure 44 is fully engaged, this is not necessary to carry forth the full intent of the invention so long as slot 50 is dimensioned to communicate with interior 52 up to the point where the fastener structure 44 becomes fully engaged, thus providing a pathway for any retained liquid to drain from the interdental spaces between the fastener structure 44 on the interior wall surface of container body 42.

Figure 7:
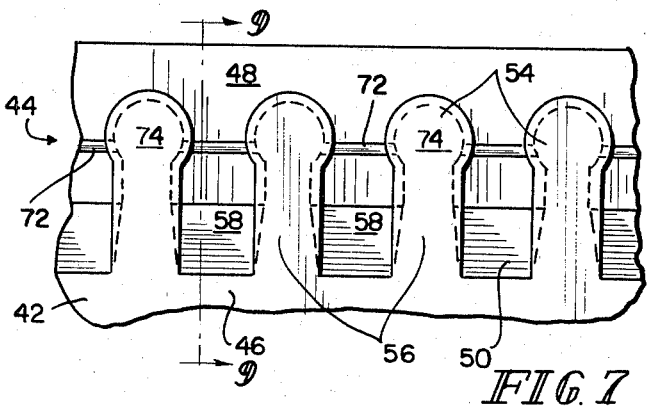
FIG. 7 is a fragmentary elevational view of the fastener elements on the lip of a can according to the present invention as viewed from the inside of that can.
Figure 9:
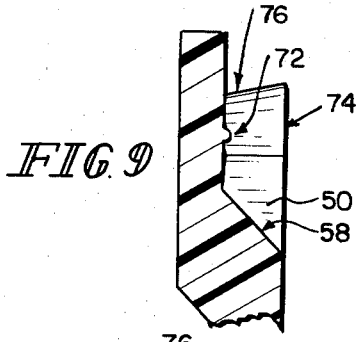
FIG. 9 is a sectional view of the fastener structure illustrated in FIGS. 7 and 8 taken along section line 9—9.
Figure 8:
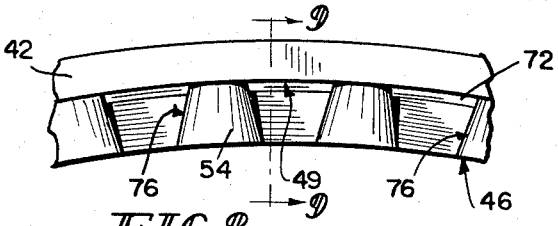
FIG. 8 is a plan view of the fastener structure illustrated in FIG. 7.
Figure 11:
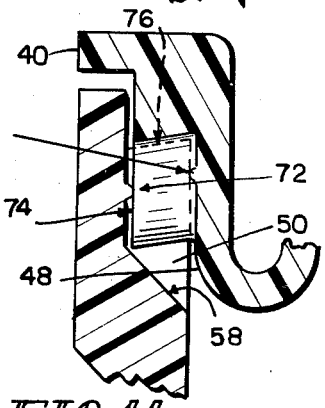
FIG. 11 is a sectional view through the lid illustrated in FIG. 10, cut along line 11—11 combined with the section illustrated in FIG. 9 to show a view similar to FIG. 6.
Figure 10:
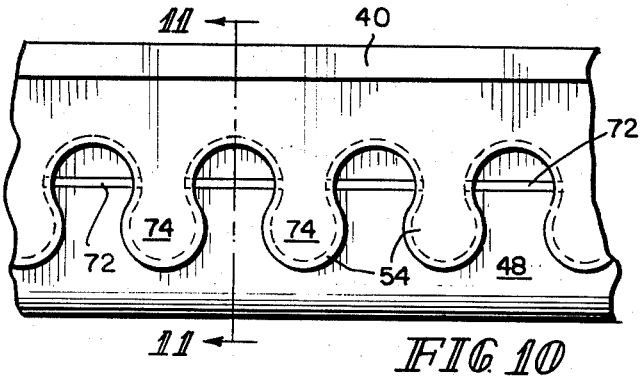
FIG. 10 is a fragmentary elevational view of the fastener elements on a lid constructed according to the invention and adapted to interact with the fasteners illustrated in FIGS. 7–9.

To further enhance the ability of retained high viscosity liquids to escape from the interdental spaces on the can body, the lower portion 56 of elements 54 making up the fastener structure 44 are configured to be of substantially constant width as shown in FIG. 7. This permits the slots 50 intermediate the elements 54 to be substantially enlarged over that taught by the prior art and to communicate with the interior 52 of the container and lid combination at least until such time as the fastener structure 44 is substantially fully engaged. This is achieved by having the lower surface 58 of slots 50 extend downward toward the bottom of the container to a point where longitudinal surface 48 of lid 40 and interior surface 46 of container body 42 become tangent when the lid 40 and container 42 are fully engaged as shown in FIG. 6.

FIG. 6 also illustrates another feature of the present invention inasmuch as the lid 40 is illustrated to comprise a central disk 60 which constitutes a major portion of lid 40. At least one, and preferably two or more, ring-shaped steps 62 connect the central disk 60 to a lower edge 64 of the longitudinal surface 48 at the periphery of the lid 40. The intermediate ring-shaped steps 62 each include a generally radial or downwardly inclined section 66 which is substantially thinner than the remaining portions of the ring-shaped step 62. The substantially thinner sections 66 act to impart flexibility between the central disk 60 and the longitudinal surface 48 supporting the peripheral fastener structure 44. This flexibility enhances the tenacity of the lid 40 to the container body 42 even when the container is dropped and impacts on a single point of the rim of the container. While it is preferable that the thin section 66 be as thin as practical so as to enhance the flexible nature of the lid 40, sections 66 are probably practically limited to a thickness of something greater than about five thousandths (0.005) of an inch, since any thinner sections will reduce the tear strength of the material to an undesirably low level and provide insufficient structure for the container lid to retain a memory of its desired configuration.

Further, since the lid 40 is typically manufactured by injection molding to the center 68 of lid 40, the material flowing outward therefrom to the rim 70, the sections 66 must be made large enough to permit the flow through of sufficient material to form the periphery of the lid including the fastener structure 44. If the sections 66 are too thin, a dramatic pressure drop is observed across the thinned portions 66 during the injection process, and formation of the fastener structure 44 and rim 70 may, upon occasion, be incomplete. The critical thickness of section 66 will also depend upon the choice of materials made to actually form lid 40.

Figure 2:
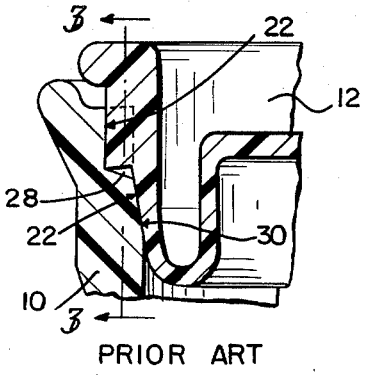
Figure 4:
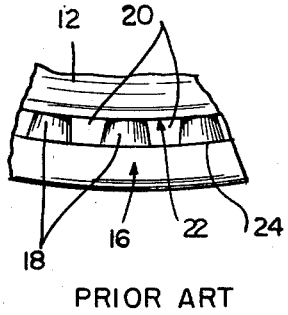
FIG. 4 is a fragmentary plan view of the fastener elements of the lid illustrated in FIGS. 2 and 3.
Figure 5:
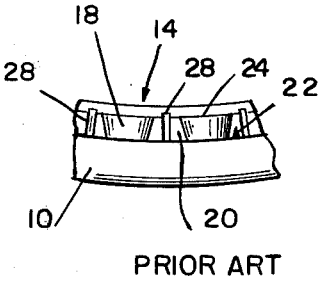
FIG. 5 is a fragmentary plan view of the fastener elements of the container body illustrated in FIGS. 2 and 3

While in the prior art as illustrated in FIGS. 1 and 2, a seal was formed below the fasteners 18 between the longitudinal supporting wall 22 of the lid 12 and the interior wall 30 of the container body 10 to effectively seal the contents of the container, the presence of enlarged slots 50 as illustrated in FIGS. 6 and 7 eliminates the presence of the seal as illustrated in FIGS. 1 and 2. Thus, an alternative placement for an effective sealing means was found necessary.

An improved seal of the present invention as illustrated in FIGS. 7–11 comprises a sealing bead 72 integrally formed on the longitudinal surfaces 49 and 48 of the container body 42 and lid 40, respectively. The sealing bead 72 is interrupted by the elements 54 of the series supported by the longitudinal surfaces 48 and 49. In this position, the sealing bead 72 contacts the free surface 74 of each element 54 of the mating series. Preferably, the sealing bead 72 is positioned on each longitudinal surface 48 or 49 immediately adjacent the widest portion of elements 54. The sealing beads 72 on the container body 42 and container lid 40, when taken together, can be considered to be a pair of interrupted sealing beads, one bead on each member of a mating set, the beads acting together when the set is connected to seal the container. The inclined surfaces 76 of the interlocking elements 52 act to force the sealing beads 72 into a sealing engagement with the free surfaces 74 of the mating elements of the fastener structure 44.

While FIGS. 7–11 illustrate the sealing beads 72 to be located on the longitudinal supporting surfaces 48 and 49, similar effects may be achieved by having a sealing bead situated on the free surfaces 74 of the elements 54, the sealing beads being forced into engagement with the supporting surfaces 48 and 49 of the lid 40 and container 42. The size of the sealing bead 72 is found to perform satisfactorily when dimensioned typically to about seven thousandths of an inch in height. The presence of the sealing beads 72 eliminates any need for a seal between the container body 10 and lid 12 below the interengaging elements as illustrated in the prior art.

Figure 12:
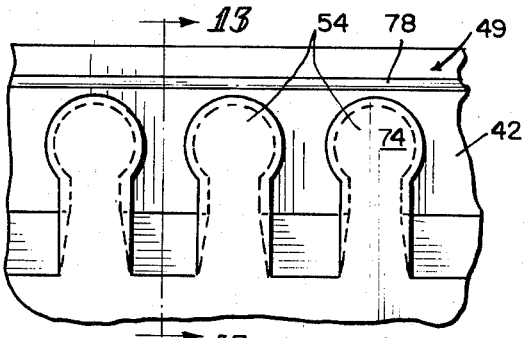
FIG. 12 is a fragmentary elevational view similar to that of FIG. 7 of another form of the invention.
Figure 13:
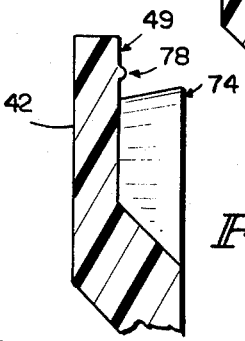
FIG. 13 is a sectional view of the fastener structure illustrated in FIG. 12 taken along line 13—13.
Figure 14:
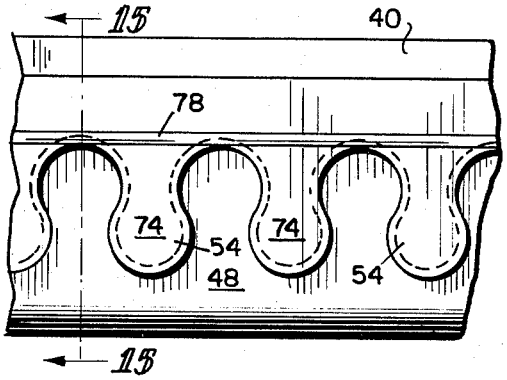
FIG. 14 is a fragmentary elevational view similar to that of FIG. 10 of an alternative embodiment of the invention.
Figure 15:
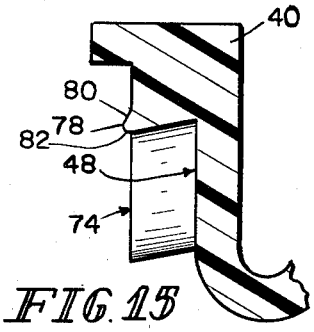
FIG. 15 is a sectional view of the present invention as illustrated in FIG. 14 taken along lines 13—13; and 14—14

While the dual interrupted sealing bead structure illustrated in FIGS. 7–11 is designed to apply maximum radial pressure on the sealing beads 72, a single or double continuous sealing bead 78 can also be employed as illustrated in FIGS. 12–16. A sealing bead 78 can be provided as illustrated in FIGS. 14 and 15 on the lid 40. Alternatively, the sealing bead 78 can be provided as illustrated in FIGS. 12 and 13 on the container 42. A single sealing bead 78 usually performs satisfactorily and either structure can be employed. In either case, it is desirable that the bead 78 be situated as close to the elements 54 of the fastener structure as possible so as to maximize the radial force applied to the sealing bead 78. The dimension of the bead 78 is preferably similar to that previously disclosed as bead 72 in FIGS. 7–11.

It is preferred that the bead 78 be contoured as shown in FIG. 15 to include a substantially planar sloped surface 80 as one edge of the bead and an arcuately formed surface 82 as the opposite edge of the bead. This contour permits the molded article to be more easily removed from the mold in which it is formed and tends to form a more satisfactory seal. While the contoured seal 78 is shown only in connection with the lid 40, it will be appreciated that the same contours could be employed on container 42. A contoured sealing bead can be incorporated in the structure shown in FIGS. 7–11 as well as FIGS. 12–16.

Figure 16:
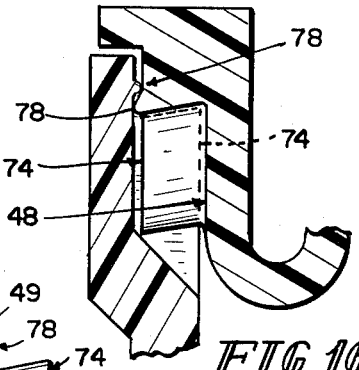
FIG. 16 is a combined sectional view similar to FIG. 11 showing the embodiments of FIGS. 12 and 14 together in cooperative engagement.

FIG. 16 shows a double continuous sealing bead being employed in the present invention. It is preferred that in that situation the beads pass each other during the lid application or removal procedure. When together as shown in FIG. 16, the seal bead on the lid is then below the seal bead on the container. While the two seal beads 78 are shown in FIG. 16 to have different contours, the contours can be the same preferably in the opposite sense so as to provide yet another interacting sealing surface.

Although the invention has been described in detail with reference to certain preferred embodiments and in comparison to various embodiments in the prior art, variations in modifications of the present invention exist within the scope and spirit of the invention as described and as defined in the following claims.

What is claimed is:

1. A container and lid of molded plastic material having a fastener structure for connecting the lid onto the container comprising two series of longitudinally and radially relieved interengaging elements, each element supported by an adjacent longitudinal surface, a sealing bead on each adjacent longitudinal surface, the bead being interrupted by the elements of each series supported by the respective longitudinal surface, the sealing bead contacting a free surface of each element of the mating series.

2. The container and lid of claim 1 wherein the sealing bead is positioned on each longitudinal surface immediately below the widest portion of the elements of the series supported thereby.

3. The container and lid of claim 1 wherein that portion of each element on the container below the sealing bead is of substantially constant width, and the space between each element on the container extends downward to substantially communicate with the interior of the container.

4. The container and lid of claim 1 wherein the sealing bead is contoured so as to include a first edge which is a substantially planar slope and a second edge which is arcuate.

5. A member of a container and lid set having a fastener structure for connecting the members of the set together comprising a series of longitudinally and radially relieved engaging elements, each element supported by an adjacent longitudinal surface, a sealing bead on the longitudinal supporting surface, the bead being interrupted by the elements of the series supported by the longitudinal surface.

6. A set consisting essentially of a container and lid of molded plastic material having an integral fastening structure for connecting the lid onto the container, a pair of interrupted sealing beads, one bead on each member of the set, the beads acting together, when the set is connected, to seal the container.

7. The apparatus of claim 6 wherein each interrupted bead is situated on a free surface of the fastener structure.

8. The apparatus of claim 6 wherein each interrupted bead is situated on a supporting surface adjacent to the fastener structure and is interrupted by the fastener structure.

9. A lid for a container comprising a substantially longitudinal surface at a periphery of the lid, a series of longitudinally and radially relieved interengaging elements supported by the substantially longitudinal surface for fastening the lid to a container, a central disk constituting a major portion of the lid, and at least one intermediate ring-shaped step having at least one section which is substantially thinner than the remaining portions of the ring-shaped step for imparting flexibility between the central disk and the periphery of the lid.

10. The lid of claim 9 further comprising a sealing bead on the substantially longitudinal surface, the sealing bead being periodically interrupted by said engaging elements.

11. A lid for a container comprising (a) a substantially longitudinal surface at the periphery of the lid, (b) a fastener structure for connecting the periphery of the lid to an inside wall of the container, the fastener structure being supported by the substantially longitudinal surface, (c) a central disk constituting a major portion of the lid, and (d) at least one intermediate ring-shaped step connecting the central portion to a lower edge of the longitudinal surface at the periphery of the lid, the at least one intermediate ring-shaped step having at least one section thinner than the remaining portions of the ring-shaped step for imparting flexibility between the central disk and the periphery of the lid.

12. The lid of claim 11 wherein the fastener structure comprises a series of longitudinally and radially relieved engaging elements, each element being supported by said substantially longitudinal surface.

13. The lid of claim 11 further comprising a sealing bead positioned on said substantially longitudinal surface.

14. The lid of claim 13 wherein the sealing bead is periodically interrupted by said fastener structure.

15. The lid of claim 13 wherein the sealing bead is positioned immediately above the fastener structure.

16. The lid of claim 11 wherein there are at least two of said intermediate ring-shaped steps, each step having at least one of said substantially thinner sections than the remaining portions of the ring-shaped steps.

17. The lid of claim 13 wherein the sealing bead is contoured to include a first edge which is a substantially planar slope and a second edge which is arcuate.

18. A container and lid of molded plastic material having a fastener structure for connecting the lid onto the container comprising two series of longitudinally and radially relieved interengaging elements, each element supported by an adjacent longitudinal surface, a space between each element on the container extending downward to substantially communicate with the interior of the container, and a sealing bead on the lid adjacent the fastener structure and above the downwardly extending spaces for sealing the container and lid.

19. The container and lid of claim 18 wherein the sealing bead is interrupted by the elements of the fastener structure.

20. The container and lid of claim 18 wherein the sealing bead is continuous and situated immediately above the elements of the fastener structure.

21. The container and lid of claim 20 wherein the sealing bead is contoured to include a first edge which is substantially an inclined plane and a second edge which is circularly arcuate.

22. The container and lid of claim 18 wherein the lid further comprises at least one ring-shaped step having a section thinner than the remaining portions of the step for imparting flexibility to the lid.

* * * * *